US006899051B2

(12) United States Patent
Sugiyama

(10) Patent No.: US 6,899,051 B2
(45) Date of Patent: May 31, 2005

(54) ANCHOR FOR SMALL BOAT

(76) Inventor: Yukitoshi Sugiyama, 5-18, Imaizumi 4-chome, Fuji-shi Shizuoka (JP), 417-0001

( * ) Notice: Subject to any disclaimer, the term of this patent is extended or adjusted under 35 U.S.C. 154(b) by 0 days.

(21) Appl. No.: 10/411,309

(22) Filed: Apr. 11, 2003

(65) Prior Publication Data

US 2003/0192464 A1 Oct. 16, 2003

(30) Foreign Application Priority Data

Apr. 11, 2002 (JP) ..... 2002-145454

(51) Int. Cl.[7] ..... B63B 21/34
(52) U.S. Cl. ..... 114/301
(58) Field of Search ..... 114/294, 295, 114/301, 303

(56) References Cited

U.S. PATENT DOCUMENTS

| | | | | |
|---|---|---|---|---|
| 16,356 A | * | 1/1857 | Dalton | 114/301 |
| 1,563,451 A | | 12/1925 | Stitcher | |
| 1,983,481 A | * | 12/1934 | Mortensen | 114/301 |
| 2,161,906 A | | 6/1939 | Filby | |
| 3,067,715 A | * | 12/1962 | Billups | 114/298 |
| 3,306,248 A | * | 2/1967 | Austin | 114/303 |
| 4,134,355 A | * | 1/1979 | Carruthers | 114/297 |
| 5,086,724 A | * | 2/1992 | Schreiber | 114/301 |
| 6,041,731 A | | 3/2000 | Willis | |

FOREIGN PATENT DOCUMENTS

| | | |
|---|---|---|
| DE | 225 678 | 8/1985 |
| DE | 36 39 023 | 6/1987 |
| GB | 2 293 578 | 4/1996 |
| JP | 60-067290 | 4/1985 |
| JP | 62-008885 | 1/1987 |
| JP | 64-005894 | 1/1989 |
| JP | 02-128989 | 5/1990 |
| JP | 03-032591 | 3/1991 |
| JP | 05-305896 | 11/1993 |

* cited by examiner

*Primary Examiner*—Andrew D. Wright
(74) *Attorney, Agent, or Firm*—Oblon, Spivak, McClelland, Maier & Neustadt, P.C.

(57) ABSTRACT

An anchor includes an anchor shank, a fluke disposed on the leading terminal side of the anchor shank as folded back therefrom, and a buoyancy part disposed on the leading terminal side of the anchor shank. The buoyancy part has a buoyant force that causes the leading terminal side of the anchor shank to rise upward and the basal terminal side thereof to contact the water bottom when the anchor is positioned on the water bottom, allows the leading terminal part of the fluke to remain in contact with the water bottom under its own weight, and enables the fluke to retain a posture for forming a given inserting angle relative to the water bottom.

7 Claims, 5 Drawing Sheets

ANCHOR FOR SMALL BOAT

BACKGROUND OF THE INVENTION

1. Field of the Invention

This invention relates to an anchor for use with a small boat.

2. Description of the Prior Art

Heretofore, various anchors have been put to use for the purpose of positioning watercraft. Generally, these anchors are each provided at the leading terminal thereof with a fluke. This is because the fluke is fastened to the water bottom and consequently the anchor is immobilized onto the water bottom, so that the watercraft to which the anchor is attached has its position fixed. In the anchor of this type, the strength with which the anchor lowered to the water bottom is fastened to the water bottom (holding strength) depends greatly on the degree with which the fluke set upright on the water bottom is dug into the water bottom.

When the fluke happens to lie flat on the water bottom or dig only at a small angle into the water bottom, the anchor of the type described above is no longer capable of securing a sufficiently hooked state because the fluke fails to dig amply into the water bottom. For the purpose of enabling the fluke 4 to rise upright, namely to assume a large digging angle relative to the water bottom, therefore, the practice of attaching a stock 3 perpendicularly to an anchor shank 2 as illustrated in FIG. 5 has been heretofore in vogue. Besides the Downforce type which has the stock directly joined to the main body of anchor, the type which has the stock 3 retained removably by a stock-retaining part provided in the main body of anchor has been known.

If the anchor is so constructed as to incorporate a stock therein as described above, however, it will become bulky as a whole because of the necessity for securing for the stock a length enough for enabling the fluke to rise upright. If the anchor is so constructed as to permit provision of a stock, it will eventually assume a shape inconvenient to carry or handle because of the inevitable necessity for disposing the stock sideways relative to the anchor shank and consequently allowing the stock to protrude laterally from the anchor shank. Further, an attempt to increase the inserting angle of the fluke will entail a proportionate elongation of the stock. In order for this anchor to ensure a satisfactory hooked state, it will become wholly bulky and gain in weight as well. On the water bottom that abounds in rocks, this anchor will allow the stock to catch hold of such rocks.

This invention has been produced in the light of this true state of affairs. An object of this invention consists in providing an anchor which, on being put to use, infallibly obtains a satisfactory hooked state by causing a fluke to contact the water bottom while forming a given angle of insertion relative to the water bottom.

Another object of this invention is to provide a light-weight anchor that permits easy handling and suffers from no ready entanglement as with rocks.

SUMMARY OF THE INVENTION

The anchor of this invention comprises an anchor shank, a fluke disposed on a leading terminal side of the anchor shank as folded back therefrom, and a buoyancy part having a bottom surface fixed onto the leading terminal side of the anchor shank. The buoyancy part has a buoyant force that causes the leading terminal side of the anchor shank to rise upward and a basal terminal side thereof to contact a water bottom when the anchor is positioned on the water bottom, allows a leading terminal part of the fluke to remain in contact with the water bottom under its own weight, and enables the fluke to retain a posture for forming a given inserting angle relative to the water bottom.

In the anchor, a normal drawn from the leading terminal part of the fluke relative to the anchor shank has a length ½ to ½.5 times a length of the anchor shank from the basal terminal side to an intersection between the normal and the anchor shank.

In the anchor, the buoyancy part assumes a streamline shape in which a forward part is made larger in size than a backward part and a height and a width are made smaller toward the backward part, and the bottom surface of the buoyancy part is substantially V-shaped in vertical cross section.

In the anchor, the basal terminal side of the anchor shank has a chain attached thereto.

In the anchor, the leading end side of the anchor shank and a basal terminal part of the fluke are joined in a form of a return bend with a turnover part.

In this invention, by having disposed at the leading terminal side of the anchor shank the buoyancy part possessing such a buoyant force as causes the leading terminal side of the anchor shank joined to the fluke to rise upward and the basal terminal side thereof to contact the water bottom when the anchor is positioned on the water bottom, allows the leading terminal part of the fluke to remain in contact with the water bottom under its own weight, and enables the fluke to retain a posture for forming a given inserting angle relative to the water bottom, the anchor is enabled to sink easily to the water bottom and, on reaching the water bottom, to acquire a powerful holding force because the leading terminal part of the fluke always remains in contact with the water bottom under its own weight and the fluke retains the inserting angle relative to the water bottom permitting the fluke to be best inserted into the water bottom.

By defining the length of a normal drawn from the leading terminal part of the fluke relative to the anchor shank to be in the range of ½ to ½.5 times a length of the anchor shank from the basal terminal side to an intersection between the normal and the anchor shank, the fluke is enabled to always form the optimum inserting angle relative to the water bottom with greater ease.

By forming the buoyancy part in a streamline shape in which a forward part is made larger in size than a backward part and a height and a width are made smaller toward the backward part and by forming the bottom surface of the buoyancy part in a substantially V-shaped vertical cross section, it is possible to reduce water resistance, make the chain less liable to be entangled with the buoyancy part, cause the buoyancy part to effectively give its buoyant force to the leading terminal part of the anchor shank and, even when the water bottom is in a sandy state, acquire a powerful holding force.

By attaching the buoyancy part removably to the anchor shank and, when the conditions of the water bottom are changed, enabling this buoyancy part to be replaced with a separate buoyancy part having a proportionately changed buoyant force, it is enabled always to exert the optimum buoyant force to the anchor.

Further, the anchor of this invention, owing to the attachment of the buoyancy part thereto, enjoys a decrease in weight and an increase in the ease of handling and, owing to the absence of a stock, allows comfortable manipulation even on a water bottom abounding with rocks.

The above and other objects and the other characteristics of this invention will become apparent from the detailed description to be given herein below based on the accompanying drawings.

BRIEF EXPLANATION OF THE DRAWING

FIG. 3(*b*) is an explanatory diagram depicting the state of ingress of the fluke of the anchor into the water bottom from the position of FIG. 3(*a*).

FIG. 3(*c*) is an explanatory diagram depicting the state of fastening to the water bottom of the fluke of the anchor of FIG. 3(*a*).

DESCRIPTION OF THE PREFERRED EMBODIMENT

Figure 1:
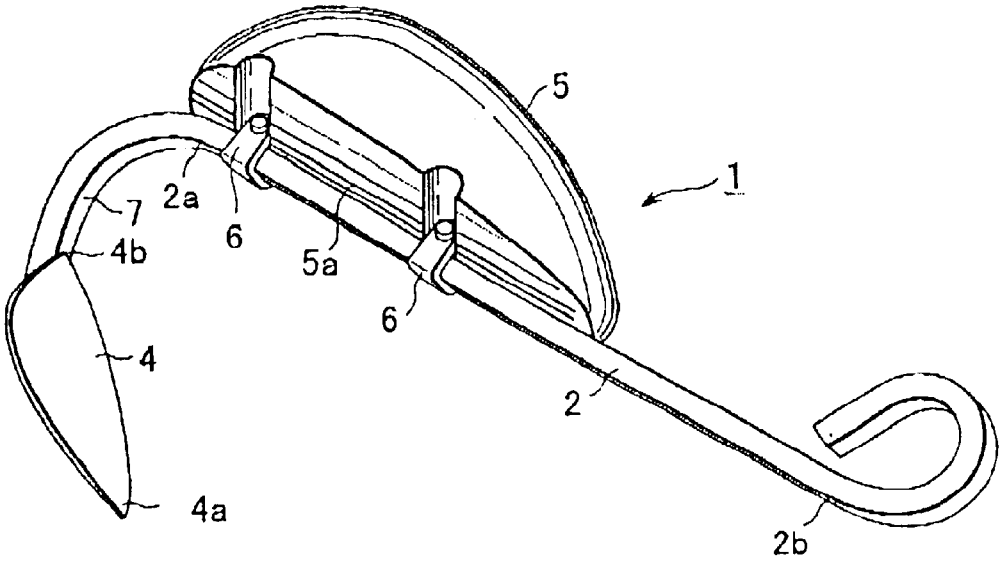
FIG. 1 is a perspective view illustrating one embodiment of the anchor of this invention.
Figure 2:
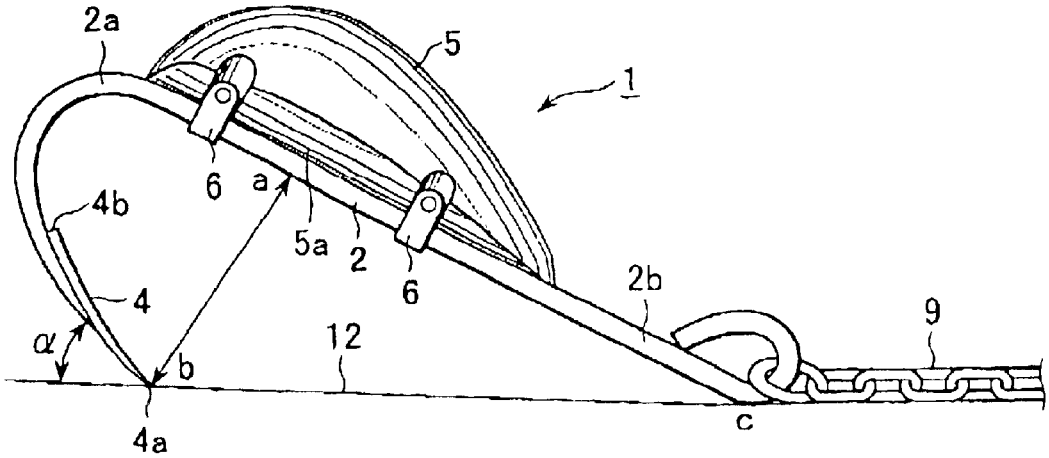
FIG. 2 is a side view of the anchor shown in FIG. 1.

FIG. 1 and FIG. 2 illustrate one embodiment of the anchor contemplated by this invention for use with a small boat. An anchor 1 comprises an anchor shank 2 and a fluke 4. The leading terminal side 2*a* of the anchor shank 2 and the basal terminal part 4*b* of the fluke 4 are joined in the form of a return bend. A buoyancy part 5 is attached through attaching members 6 to the leading terminal side 2*a* of the anchor shank 2.

In the embodiment of FIG. 1, the buoyancy part 5 is fixed to the anchor shank 2 using two strap-shaped attaching members 6. However, the attaching members 6 may have a different shape.

The leading terminal side 2*a* of the anchor shank 2 is selected as the site for attachment of the buoyancy part 5 to the anchor shank 2. This selection results in facilitating the adjustment of the posture of the anchor in the water. The expression "the leading terminal side 2*a* of the anchor shank" as used herein means the position of the anchor shank 2 that is approximated to the side of the fluke 4 as illustrated in FIG. 2. By the same token, the expression "the basal terminal part 4*b* of the fluke" means the position of the fluke 4 that is approximated to the side of the anchor shank 2 and the expression "the leading terminal part of the fluke 4" means the opposite of the basal terminal part thereof, namely the leading terminal part 4*a* which is fastened to the water bottom.

The buoyant force which the buoyancy part 5 exerts on the anchor shank 2 and the fluke 4 effects such adjustments as causing the leading terminal side 2*a* of the anchor shank 2 to rise and the basal terminal side 2*b* thereof to contact the water bottom and inducing the basal terminal part 4*b* of the fluke 4 to rise upward and the leading terminal part 4*a* thereof to retain the state of ground contact under its own weight. As a result, the weight of the overall anchor under water becomes around ⅓. The connection of a chain 9 to the basal terminal side 2*b* of the anchor shank 2 is at an advantage in ensuring the maintenance of the state of ground contact under the weight thereof.

A normal drawn from point b that is the leading terminal part 4*a* of the fluke 4 relative to the anchor shank 2 has a length $1/1.8$ to $1/3.0$ times, preferably ½ to $1/2.5$ times the length of the anchor shank 2 from point c that is the basal terminal side to an intersection a between the normal and the anchor shank 2. By defining the anchor shank length as described above, the inserting angle for the fluke easy to fasten to the water bottom can be formed even in respect of an anchor with a fluke having an open angle of 30° or an anchor with a fluke and an anchor shank parallel to each other.

In the illustrated embodiment, the buoyancy part 5 assumes a streamline shape, in which the forward part is made larger in size than the backward part and the height and width are made smaller toward the backward part, and is disposed as being carried on the back of the leading terminal part of the anchor shank 2. This shape is preferred because it can reduce water resistance and eliminate entanglement of the chain 9 with the buoyancy part 5. Since the buoyancy part 5 can exert a large buoyant force onto the leading terminal part of the anchor shank, the anchor shank is enabled to rise effectively with a small buoyant force.

As shown in FIG. 1, the buoyancy part 2 has a bottom 5*a* substantially V-shaped in vertical cross section. With this configuration, in the case of the water bottom of sand or soft soil, the fluke 4 is dug into the water bottom while the bottom of the buoyancy is kept in contact with the water bottom, thereby acquiring powerful anchorage.

In the illustrated embodiment, the buoyancy part 5 is fixed to the anchor shank 2 via the strap-shaped attaching members 6 that straddle the anchor shank 2 and are fixed at the end portions thereof to the buoyancy part 5 with screws. Loosening the screws enables the buoyancy part 5 to be removed from the anchor shank 2 with ease. This construction enables the buoyancy part 5 to be replaced with another one having a proper buoyant force depending on the conditions of the water bottom and enjoys very high general-purpose properties.

The buoyancy part 5 does not need to discriminate the material to be used therefor but is only required to be so constructed as to fulfill the function of producing a necessary buoyant force. For example, a metallic material (such as a stainless steel material or a material which has undergone a given plating treatment) or a non-metallic material (a macromolecular material, such as a resin material) may be formed in a hollow shape. It may be in a solid form when the material itself floats in water and has a buoyant force enabling the anchor shaft to rise.

When the anchor having the anchor shank equipped with the buoyancy part has been thrown into water, since the basal terminal part 4*b* of the fluke 4 is directed upward by the buoyant force of the buoyancy part 5 as described above despite the maintenance of the leading terminal part 4*a* thereof in the state of ground contact, the anchor is retained in the state of incessant rising. Owing to this construction, pulling the chain 9 enables the leading terminal part 4*a* of the fluke 4 to fasten satisfactorily to the water bottom while retaining the basal terminal side of the anchor shank in the state of ground contact. When the water bottom is formed of gravels or stones, for example, the fluke 4 is enabled to acquire powerful anchorage (powerful holding strength) by amply digging into the water bottom. In the illustrated embodiment, part of the anchor shank 2 is formed as a turnover part 7 continuing from the linear part of the anchor shank 2 (the rectilinear part of the anchor shank 2) on the leading terminal side of the anchor shank 2. To be specific, the turnover part 7 is formed as bent or turned off from the linear part. Though part of the anchor shank 2 is formed as the turnover part in the embodiment of FIG. 1, a separate member connected to the anchor shank may be formed as the turnover part. For example, the fluke 4 may be so formed as to serve as a turnover part. The buoyancy part 5 is disposed on the leading terminal side of the anchor shank. It may be optionally disposed in the turnover part on condition that the buoyant force thereof functions in the same manner as when it is disposed on the leading terminal side of the anchor shank.

FIG. 1 and FIG. 2 depict the case of providing the anchor shank with only one fluke. This invention allows use of a plurality of such flukes on condition that the construction incorporating them therein can conform to the concept of this invention.

Figure 3A:
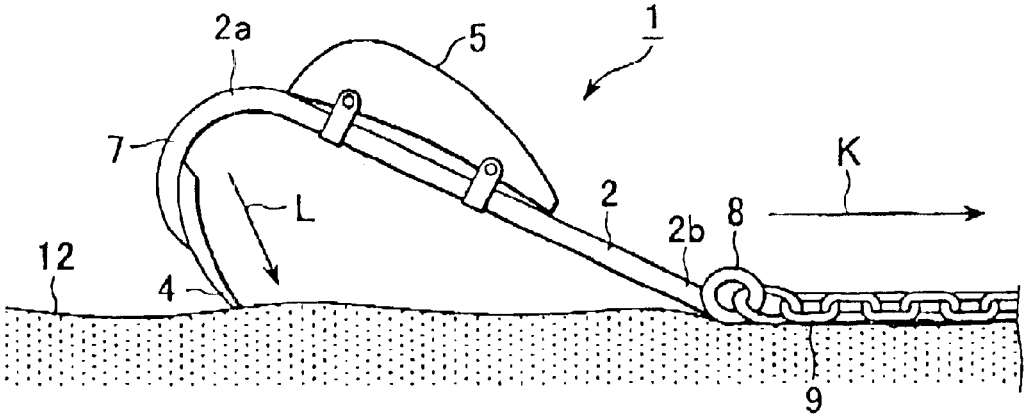
FIG. 3(*a*) is an explanatory diagram depicting the anchor of this invention posed on the water bottom.
Figure 3B:
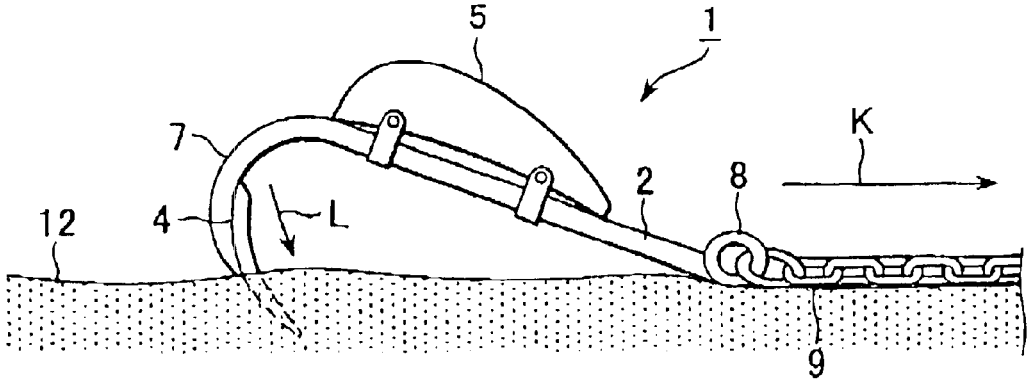
Figure 3C:
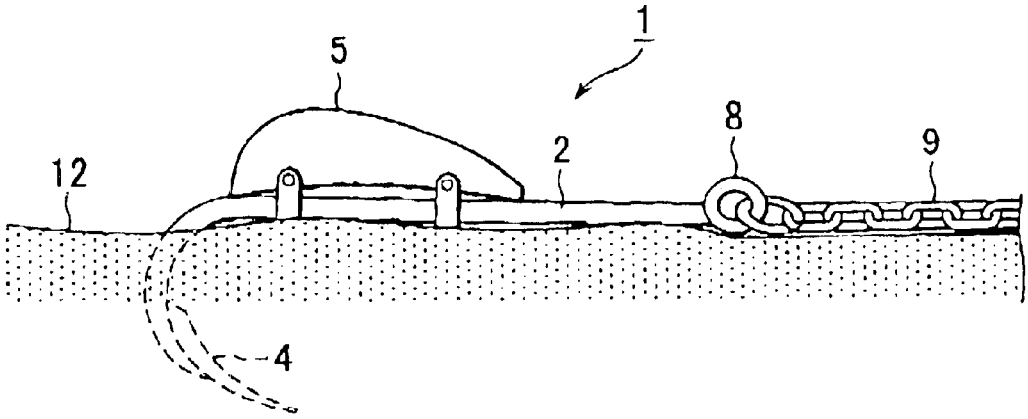

FIG. 3 depicts the function that is fulfilled by the anchor of this invention on the water bottom. On the water bottom 12, the neighborhood of the leading terminal side of the anchor shank is pulled upward (in the direction of the water surface) by the buoyancy part 5 while the leading terminal part of the fluke 4 is eventually positioned on the water bottom under its own weight as illustrated in FIG. 3(*a*). The leading terminal of the fluke 4 is eventually directed vertically downward or obliquely downward. Incidentally, the buoyant force of the buoyancy part 5 partially raises the neighborhood of the leading terminal side of the anchor shank as described above. The shape and the material of the buoyancy part 5 are so adjusted that the buoyant force generated thereby is enough to raise the anchor 1 upright and not enough to float the fluke 4 wholly. When the chain 9 is dragged in the direction of the arrow mark K while the anchor 1 remains in contact with the water bottom as illustrated in FIG. 3(*a*), the fluke 4 eventually sinks downward or obliquely downward as indicated by the arrow mark L. When the chain 9 is attached to one terminal of the anchor shank 2 as illustrated in FIG. 3(*a*), the one terminal side of the anchor shank to which the chain 9 is attached is rendered less easily floatable. That is, the chain 9 functions as one kind of a weight member. Even when a rope 10 (shown in FIG. 4) is pulled, the chain 9 is moved as though it were crawling on the water bottom 12 as indicated by the arrow mark K. In this construction, therefore, the basal terminal side of the anchor shank 2 is moved in the same manner as the chain 9, the leading terminal part of the fluke 4 begins digging in the water bottom, and the leading terminal side of the anchor shank is held in a rising state by the buoyancy part 5. As illustrated in FIG. 3(*b*), the fluke 4 is gradually sunk aslant downward. When the water bottom is in a sandy state, the pull of the chain 9 induces the fluke 4 to advance into the sand, the anchor shank to be buried in the sand owing to the V-shaped bottom surface of the buoyancy part, and the buoyancy part to come into tight contact with the water bottom, thereby eventually fastening the anchor to the water bottom. Even when the water bottom is formed of stones or rocks, the leading terminal side of the fluke 4 that tends to sink downwardly fastens easily to the water bottom and eventually produces a satisfactory hooked state as shown in FIG. 3(*c*). In the present embodiment, the construction which has the buoyancy part 5 positioned outside the anchor shank 2 (the side opposite the side forming the turnover part) and has this buoyancy part 5 produce such a buoyant force as raises part of the anchor shank 2 or the fluke 4 has been explained. Optionally, the buoyancy part 5 may be positioned inside the anchor shank 2 and adapted to produce such a buoyant force as push the anchor shank 2 or the fluke 4 from below upward.

Figure 4:
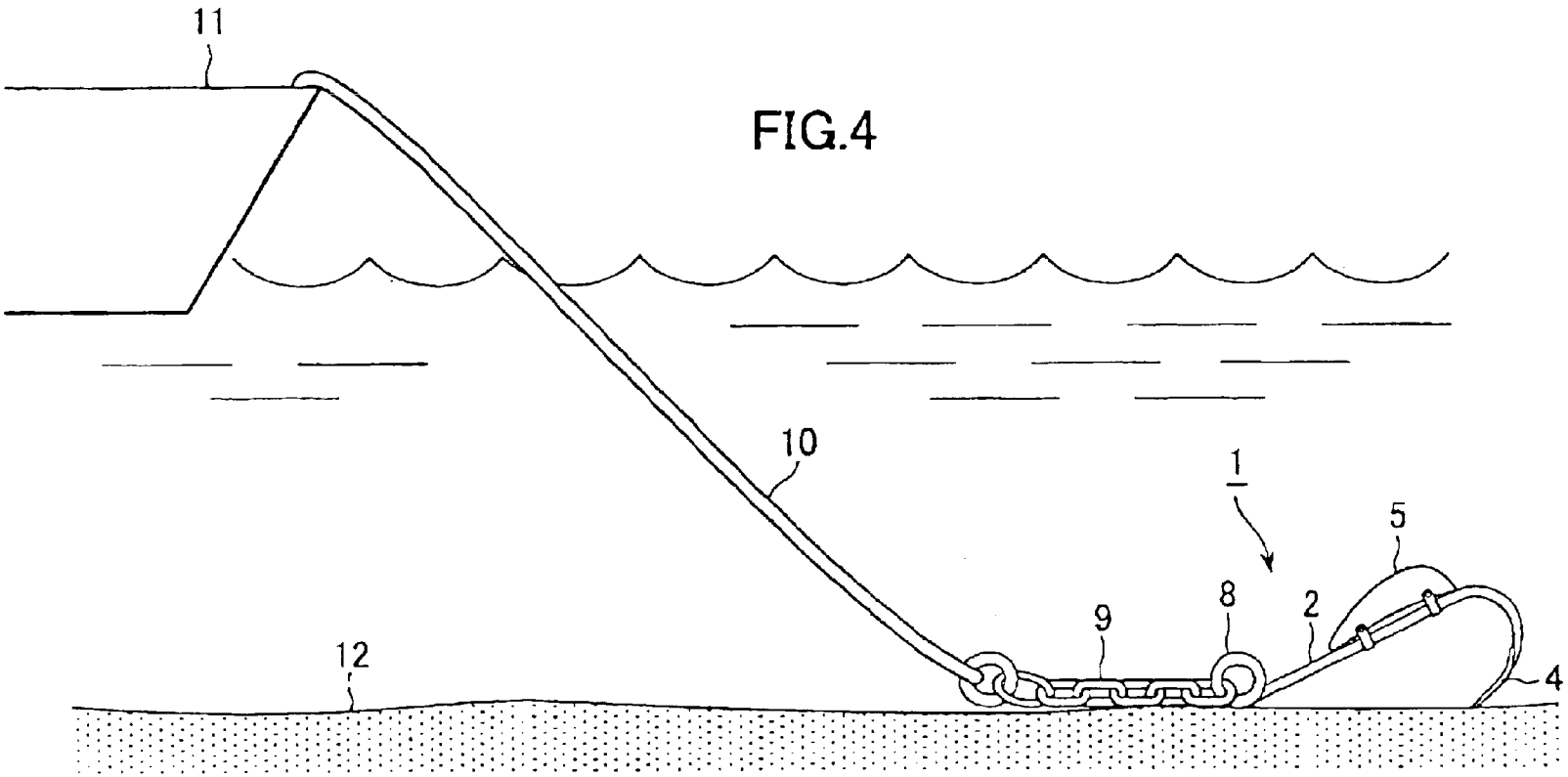
FIG. 4 is an explanatory diagram depicting the state of use of the anchor of this invention.
Figure 5:
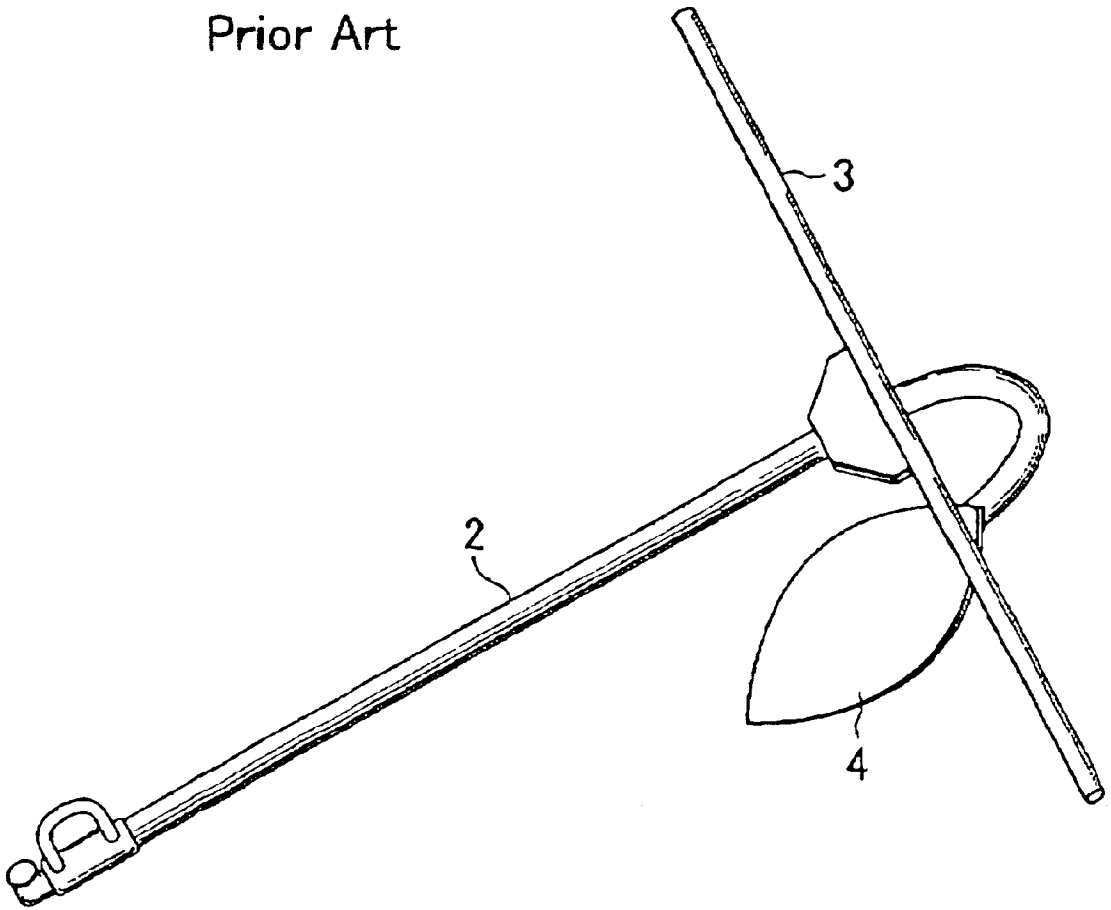
FIG.5 Prior Art
FIG. 5 is a perspective view illustrating one example of the conventional anchor.
Figure 6:
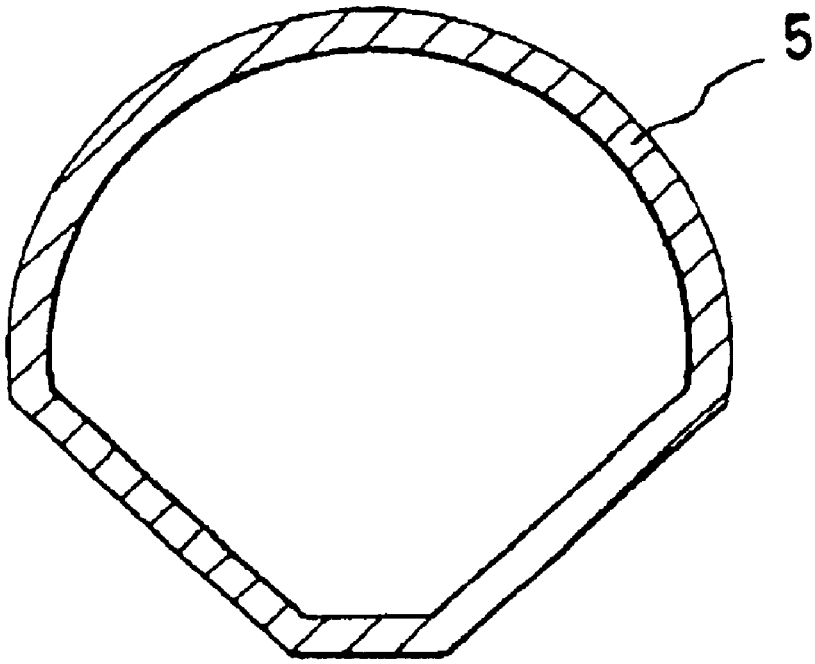
FIG. 6 is a cross-sectional view of the buoyancy part, removed from the anchor shaft.

FIG. 4 illustrates a working example of this invention. It depicts the construction having a rope 10 extended from a watercraft 11 and then attached to a chain 9 disposed on the anchor 1 in the pattern of a type section. The working example of FIG. 4 depicts the case having the chain 9 attached to a connecting ring 8 formed as a connecting member in the terminal part of the anchor shank 2 as shown in FIG. 3 and having the rope 10 attached to the leading terminal of the chain. In spite of this illustration, the rope 10 may be directly attached to the connecting ring 8. Then, even when the rope 10 is pulled from the watercraft 11, the watercraft acquires a satisfactory hooked state and remains at the given position because the leading terminal side of the anchor shank 2 in the anchor 1 rises (namely, it is pulled up in the direction of the water surface side by the buoyant force of the buoyancy part 5) and the leading terminal of the fluke 4 sinks down and fastens with the water bottom under its own weight.

In a conventional anchor with a stock, used on the water bottom that abounds in rocks, the stock is sometimes allowed to catch hold of such rocks and cannot be removed from the rocks. In this case, the rope has to be cut off to leave the stock on the water bottom, resulting in water pollution. This can be eliminated in the present invention because no stock is provided on the anchor of the present invention.

Furthermore, since the shape of the buoyancy part attached to the anchor shank is a streamline shape in which the forward part is made larger in size than the backward part and the height and width are made smaller toward the backward part, it can reduce water resistance and eliminate entanglement of the chain with the buoyancy part. In addition, since the buoyancy part can exert a large buoyant force onto the leading terminal part of the anchor shank, the anchor shank is enabled to rise effectively with a small buoyant force.

Moreover, since the bottom surface of the buoyancy part is substantially V-shaped in vertical cross section, it is possible for the fluke to be dug into the water bottom of sand or soft soil, acquiring powerful anchorage.

A few examples of the anchor contemplated by this invention have been described. The examples thus cited are examples in any event and, thus, may of course incorporate therein such requirements for construction as will be inferred by any person of ordinary skill in the art or may be altered as in shape without departure from the spirit of this invention.

What is claimed is:

1. An anchor comprising:

an anchor shank, a fluke disposed on a leading terminal side of said anchor shank as folded back therefrom, a buoyancy part having a bottom surface removably attached to the leading terminal side of said anchor shank, said buoyancy part configured to provide a buoyant force to cause the leading terminal side of said anchor shank to rise upward and a basal terminal side of the anchor shaft to contact a water bottom when the anchor is positioned on the water bottom, to allow a leading terminal part of said fluke to remain in contact with the water bottom under its own weight, and to enable said fluke to retain a posture for forming a given inserting angle relative to the water bottom, and a plurality of attaching fasteners configured to attach the buoyancy part to the anchor shaft.

2. The anchor according to claim 1, wherein a normal drawn from the leading terminal part of the fluke relative to the anchor shank has a length ½ to ½.5 a length of the anchor shank from the basal terminal side to an intersection between the normal and the anchor shank.

3. The anchor according to claim 1, wherein the buoyancy part comprises a streamline shape in which a forward part is larger in size than a backward part and a height and a width are smaller toward the backward part.

4. The anchor according to claim 1, wherein the bottom surface of the buoyancy part comprises a substantially V-shaped cross section.

5. The anchor according to claim 1, further comprising:

a chain attached to the basal terminal side of said anchor shank.

6. The anchor according to claim 1, wherein said fluke is configured to be removably attached to the leading terminal side of said anchor shank.

7. The anchor according to claim 1, wherein the leading terminal side of said anchor shank and a basal terminal part of said fluke are joined in a return bend with a turnover part.

* * * * *